US005338068A

United States Patent [19]

Arbach et al.

[11] Patent Number: 5,338,068

[45] Date of Patent: Aug. 16, 1994

[54] BUSINESS FORM/RECEIPT RECORDING SYSTEM

[76] Inventors: Gary Arbach; Leonard Bradshaw, both of 14489 Crestwood Ave., Poway, Calif. 92064

[21] Appl. No.: 157,534

[22] Filed: Nov. 26, 1993

[51] Int. Cl.[5] ..... B42D 15/00

[52] U.S. Cl. ..... 283/116; 462/65

[58] Field of Search ..... 283/116; 229/68 R; 462/6, 64, 65

[56] References Cited

U.S. PATENT DOCUMENTS

| | | | |
|---|---|---|---|
| 1,479,280 | 1/1924 | Brown | 283/116 X |
| 1,591,231 | 7/1926 | Otis | 462/65 |
| 2,129,192 | 9/1938 | Benkowitz | 283/116 |
| 2,166,439 | 7/1939 | Johnson | 462/65 |

*Primary Examiner*—Mark Rosenbaum
*Assistant Examiner*—Willmon Fridie
*Attorney, Agent, or Firm*—Brown, Martin, Haller & McClain

[57] ABSTRACT

A sheet of foldable material has four panels, separated from each other by parallel folds with a pocket for storing receipts being formed by folding the lower two panels together. The sheet has adhesive along two or more edges or on tabs projecting from the edges for sealing the folded sheet when creating the pocket. The upper and center panels have a business form such as an expense report that corresponds to the stored receipts. The form may have overlaid on it one or more detachable sheets of self-duplicating paper, such as carbon paper or "carbonless paper," for forming duplicates of the business form. When the form is complete the panels are folded over each other and sealed with adhesive strips along the sides of the sheet. The folded sheet and accompanying receipts may be mailed to the appropriate recipient or location for entry into an accounting system.

24 Claims, 2 Drawing Sheets

BUSINESS FORM/RECEIPT RECORDING SYSTEM

BACKGROUND OF THE INVENTION

This invention relates generally to business forms and envelopes and, more specifically, to a business form that retains receipts in an integral pocket and can be folded and sealed to form an envelope for mailing.

Economical operation of a business requires careful monitoring of the costs of doing business, including the expenses incurred by employees for promotional visits, sales meetings, and field service calls. Meticulous tabulation of these expenses is also required for income tax purposes. Typically, the monitoring is achieved by requiring employees of the business to tally these expenses on a daily basis, with a breakdown of expense categories such as meals, entertainment, transportation and lodging. The employee fills in the form with the amounts expended and returns the form to the employer's accounting department on a regular basis, such as weekly, monthly or bimonthly. The employee is also usually required to provide the accounting department with a receipt for each expense item entered on the form.

The receipts range in size from small ticket stubs to full size sheets of paper, making it easy for the employee to misplace a receipt between the time that he or she receives it and the time that the expense form is filled out and submitted. Moreover, receipts can become separated from the corresponding expense form either in transit from the employee to the accounting department or during processing in the accounting department.

Many business forms have been devised which provide a combination order form, check and envelope (U.S. Pat. No. 2,116,230 of Berkowitz), a statement and envelope (U.S. Pat. No. 826,492 of Dewes), a pay stub and envelope (U.S. Pat. No. 2,118,064 of Baechle), an arrival notice and envelope (U.S. Pat. No. 1,884,669 of Hannan), a file envelope and contents form (U.S. Pat. No. 2,503,592 of Pate) and an invention record and envelope (U.S. Pat. No. 2,408,626 of Green). Also commercially available are TOPS TM form travel planners, including a pocket travel itinerary with a built-in pocket, and a weekly expense envelope, consisting of an envelope with a form printed on both sides.

None of the available forms are equally convenient for all aspects of the recordkeeping process, i.e., for the employee's receipt saving and tabulation of expenses, for sending the table and receipts to the accounting office, and for maintaining records in the accounting office. In fact, the configurations of many of the above-identified forms may act as a hinderance to convenient storage of the forms that are received in the accounting office, since they are odd sizes and are not designed for storage in standard size files.

SUMMARY OF THE INVENTION

It is an advantage of the present invention to provide a recordkeeping system which permits collection of individual tickets and/or receipts while an integral form summarizing data from the tickets and/or receipts is filled out.

Another advantage of the present invention is to provide a means for submitting collected tickets and/or receipts and corresponding tabulated information in an integral envelope.

Still another advantage of the present invention is to provide an integrated record-keeping system which includes a standard size formfor convenient storage of completed forms in, for example, three-ring binder or filers.

In the exemplary embodiment, the present invention comprises a sheet of paper or card-stock divided into four sections by parallel folds. The folds are approximately equidistant from each other and from the upper and lower edges of the envelope. Integral with the uppermost panel and the lowermost panel are side tabs, so that these two panels are wider than the two center panels. Adhesive strips with a protective peel-off covering, running parallel to the sides of the sheet are located on each of the tabs. The uppermost and top center panels or portions thereof have a business form printed on them. Alternatively, the form may be printed on a separate sheet of paper permanently or detachably secured to the upper and center panels. In any embodiment, the form may have overlaid on it and attached with a light adhesive, one or more detachable sheets of self-duplicating paper, such as carbon paper or "carbonless paper," for forming duplicates of the business form.

A pocket for storage of tickets and/or receipts is formed by folding the lowermost panel up onto the lower center panel, removing the protective strips from the adhesive strips on the lower panel and folding the tabs so that the adhesive sticks to the back of the lower center panel. The pocket may also have one or more dividers formed by placing separate panels within the pocket. The dividers can be imprinted with categories corresponding to those on the form, e.g., "Meals", "Lodging", etc.

The business form may, for example, be an expense report. An employee can carry the form with him or her and, each time an expense is incurred, enter the amount on the form and insert the corresponding receipt into the pocket. When the form is complete, such as at the end of a week, the employee folds the pocket up against the top center panel then once again against the upper most panel. The protective strips are removed from the adhesive strips on the uppermost panel and the tabs are folded over and attached to the top center panel to seal the resulting envelope using the adhesive strips. If the sheet has self-duplicating paper, the employee may retain one of the duplicates before folding the form. On the back of either the uppermost or top center panels a mailing address or routing information is printed so that it is exposed when the sheet is folded to form an envelope. All that is then required to submit the package to the individual's accounting office is to place a stamp on the envelope, if it is to be mailed, then deposit the envelope in a mail box or other delivery means.

The edges of the business forms may have perforations separating them from the remainder of the sheet (the tabs and the pocket). The sealed envelope can be opened by breaking the perforations, revealing the form. The perforations along the pocket may be broken to separate the pocket, leaving a substantially flat form that can be easily filed. Alternatively, the pocket may be left intact and the form stored with the contents of the pocket remaining in it. One edge of the sheet may have holes for retaining it in a ring binder.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF THE PREFERRED EMBODIMENT

Figure 1:
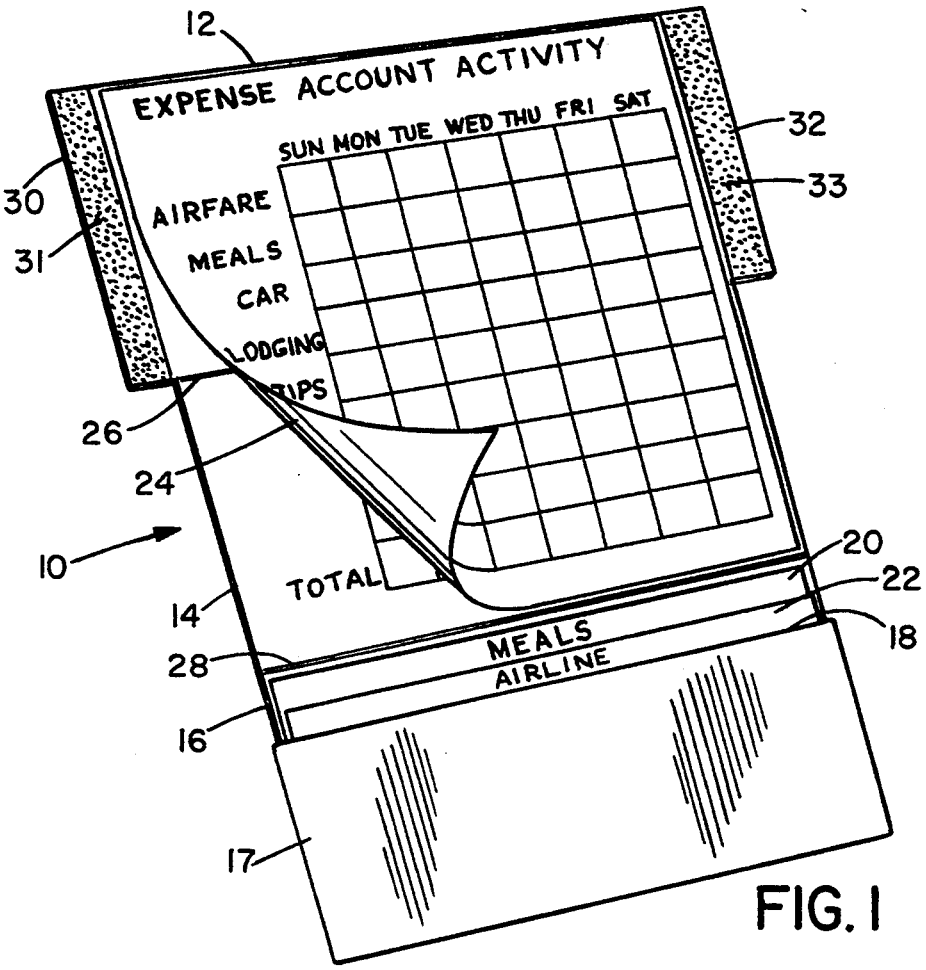
FIG. 1 is a perspective view of the envelope of the present invention, showing a typical business form.

As illustrated in FIG. 1, the present invention is formed from a single sheet 10 of a foldable material, such as paper or cardstock. Sheet 10 has an uppermost panel 12, a top center panel 14, and a lower center panel 16 and lowermost panel 17. A pocket 18 is formed by folding lowermost panel 17 over lower panel 16 when the form is ready for use. As described in further detail below, any number of dividers, such as dividers 20 and 22, may be disposed in pocket 18 to separate the contents of pocket 18.

Sheet 10 has a business form such as an expense report printed on a portion of its inside surface, primarily of panels 12 and 14, and may also have a duplicate sheet 24 made of "carbonless" self-duplicating paper overlaid on the expense report and detachably secured with a small bead of light adhesive along the upper edge of upper panel 12. The expense report may have rows labeled to represent categories of expenses likely to be incurred and columns labeled to represent the days of the week or other convenient time periods.

To use the present invention, the amount of each expense item is entered in the appropriate space on the expense report. Receipts issued for expense items are inserted into pocket 18. Dividers 20 and 22 are labeled with expense categories that correspond to one or more of the categories on the expense report, and may be used to sort the receipts inserted into pocket 18. When the expense report is completed, such as at the end of the week, duplicate sheet 24 is detached. Sheet 10 is folded to form an envelope and sent to the appropriate recipient for entry into the business' accounting system.

Figure 2:
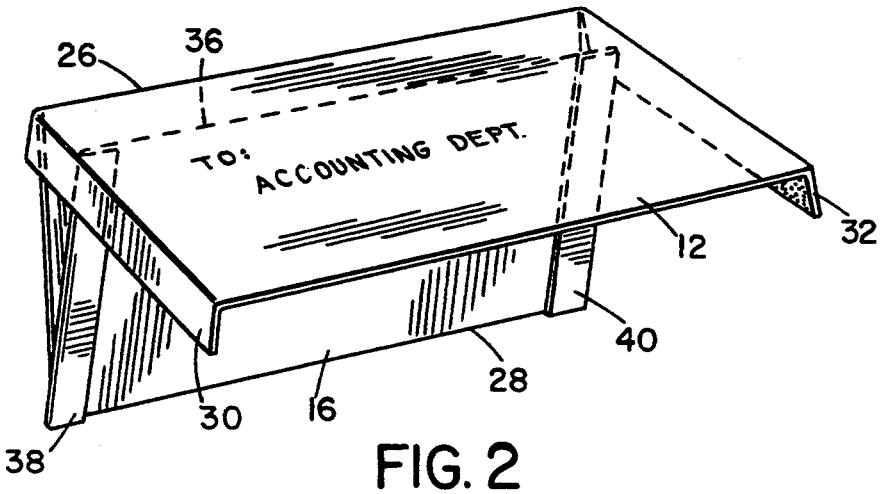
FIG. 2 is a perspective view of a partially folded envelope.
Figure 3:
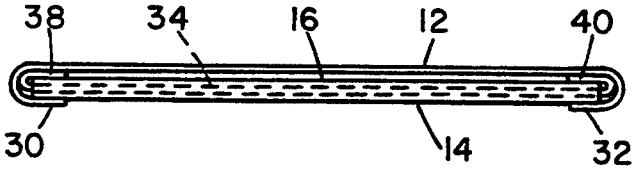
FIG. 3 is side elevation view of the folded and sealed envelope.

In FIG. 2, sheet 10 is folded, first along a lower fold line 28 until the inside surface of lower panel 16 is in contact with the inside surface of center panel 14, and then along an upper fold line 26 until the inside surface of upper panel 12 is in contact with the outside surface of lower panel 16. Although the envelope may be sealed in any suitable manner, sheet 10 preferably has envelope sealing tabs 30 and 32 extending from the edges of upper panel 12. Tabs 30 and 32 are covered with a adhesive, such as a pressure-sensitive strips 31 and 33, or a remoistenable glue. The adhesive may be covered with a plastic- or silicone-coated strip which is peeled off when the envelope is ready to seal. After sheet 10 is folded, tabs 30 and 32 are folded over the edges of center panel 14 and lower panel 16. The adhesive is exposed or activated, and tabs 30 and 32 are secured to the outside surface of center panel 14, as shown in FIG. 3.

Figure 4:
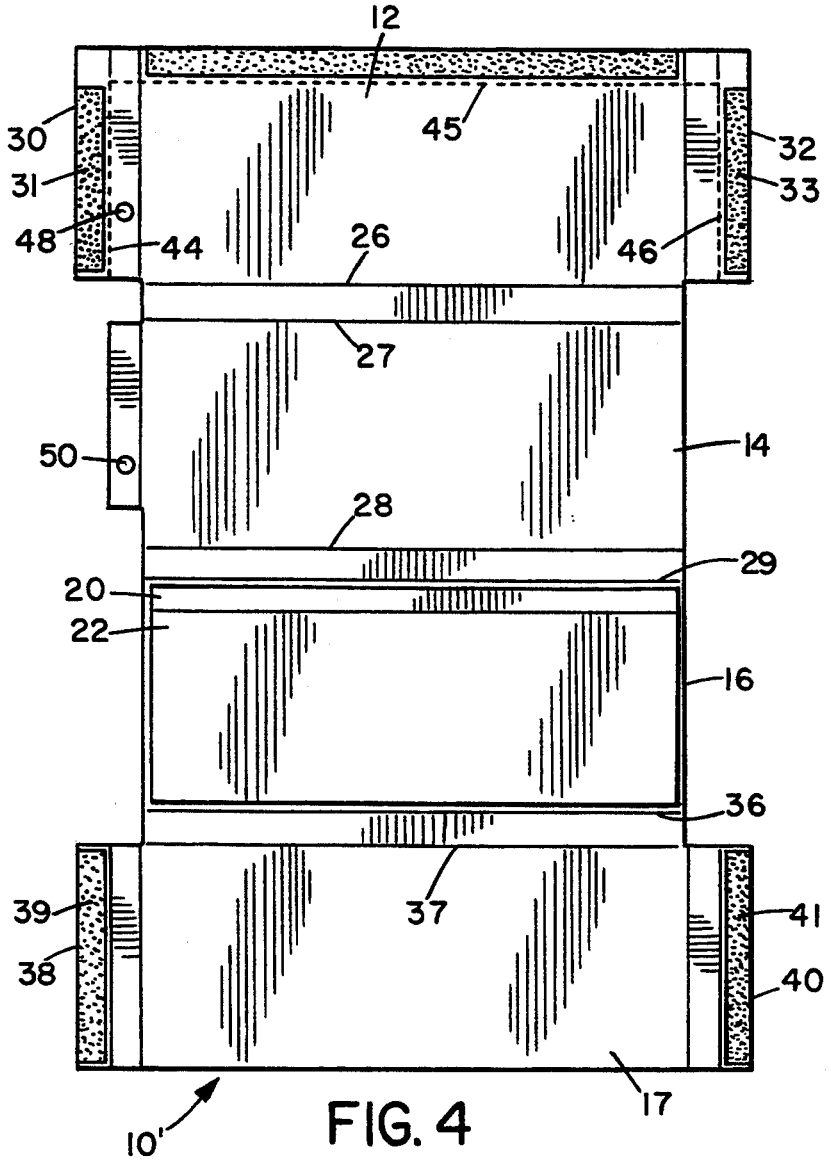
FIG. 4 is a plan view of an envelope in an unfolded state.
Figure 6:
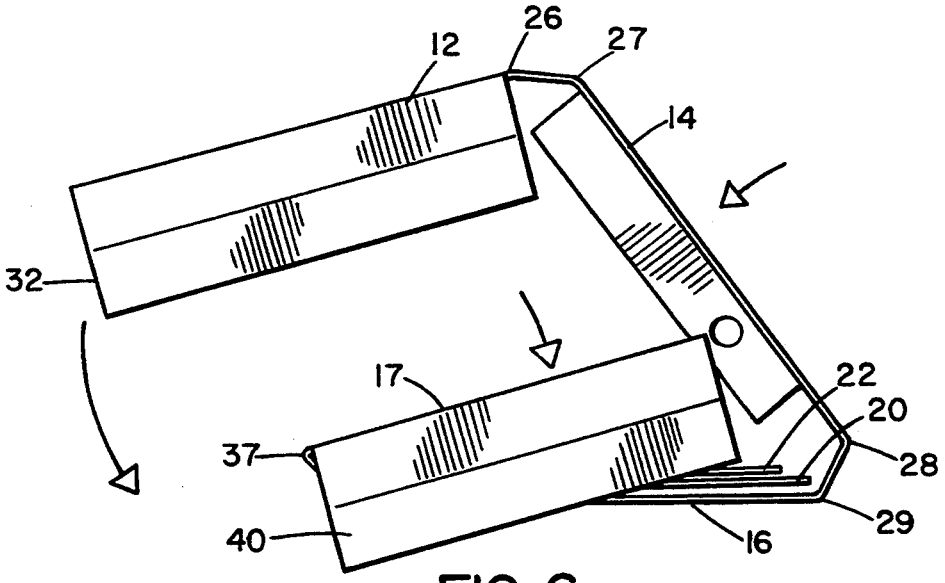
FIG. 6 is a view similar to FIG. 5 showing an envelope in a partially folded state.

In FIG. 4, sheet 10 is shown in further detail. Sheet 10 may have additional upper and lower fold lines 27 and 29, respectively, for forming a thicker or boxier envelope, as shown in FIG. 6. Although pocket 18 may be formed in any suitable manner, pocket 18 is preferably formed by folding sheet 10 at a pocket fold lines 36 and 37. Pocket panel 17 has pocket sealing tabs 38 and 40 covered with a suitable adhesive, such as pressure-sensitive strips 39 and 41 or a remoistenable glue. The adhesive is protected by coated peel-off strips which are removed when the pocket is to be assembled. As shown by the arrows in FIG. 6, pocket panel 34 is folded over dividers 20 and 22. The adhesive on tabs 38 and 40 is exposed or activated, and tabs 38 and 40 are folded over the edges of lower panel 16 and secured to the outside surface of lower panel 16, as shown in FIGS. 2–3.

The one-piece construction of sheet 10 is highly advantageous because it can be economically fabricated from a continuous web of material using machines that are well-known in the forms industry. As purchased, the forms are flat sheets without folds. Typically, the form in its original condition is 8.5 inches wide, exclusive of the tabs, and 17 inches long. This causes the finished envelope to be approximately the same size as a standard business envelope. The form can be cut from a standard size 11"×17" sheet of paper to allow excess width to form the tabs. These dimensions are not limiting, however, and other paper sizes may be used. For example, in locations where A4 paper is the standard, the form can be made to conform to those dimensions.

Adhesive may be provided in other or additional locations, such as an adhesive strip 42 along the upper edge of panel 12. Moreover, although in the illustrated embodiment sheet 10 has sealing tabs 30, 32, 38, and 40, sheet 10 need not include any tabs, and may have strips of adhesive along the edges of the rectangular region that has the business form within it.

Figure 5:
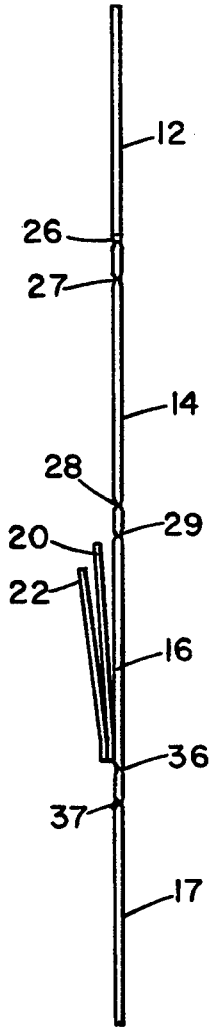
FIG. 5 is an end view of the envelope of FIG. 4.

With reference to FIGS. 4–6, it should be noted that dividers 20 and 22 need not be secured to sheet 10 or to each other, and may be inserted in pocket 18 after pocket 18 is formed. Alternatively, dividers 20 and 22 may be secured by a small amount of adhesive along the inside surface of fold line 36 or at another suitable location.

The sealed envelope may be opened by tearing tabs 30 and 32 along the lines on which they are folded. Alternatively, sheet 10 may be made wider than a standard form (e.g., 8½ inches) and may have perforations 44, 45 and 46 along its vertical edges and top horizontal edge, as shown in FIG. 4. To open the envelope, a strip can be torn off along each line of perforations and discarded, leaving a standard sized form. Dividers 20 and 22 may have perforations along the same lines.

Sheet 10 may have holes 48 and 50 for storing the unfolded envelope in a ring binder.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. An integral business form for recording business information, saving receipts and submitting the business information and receipts to a given location, said form comprising:

a rectangular sheet having inner and outer surfaces, an upper edge, a lower edge, two side edges, an upper panel, two center panels, and a lower panel with each panel separated from the other panels by a fold line;

a first adhesive disposed on each of said two side edges within said lower panel;

a second adhesive disposed on each of said two side edges within said upper panel;

a printed table extending across said inner surface of at least said upper panel and the adjacent center panel for entering business information;

a printed address of said given location on said outer surface of one of said upper panel and said two center panels;

wherein a pocket for storing said receipts is formed by folding along a lower fold line between lower panel and the adjacent center panel and sealing the lower and the adjacent center panels together along said two side edges with said first adhesive and an envelope for submitting said business information and receipts is formed by folding along a center fold line between said two center panels and an upper fold line between said upper panel and the adjacent center panel and sealing said envelope with said second adhesive.

2. The form described in claim 1 wherein said first adhesive is disposed on a first set of tabs, one tab of said first set extending from each of said two sides within said lower panel, wherein each tab is folded inward to seal said pocket.

3. The form described in claim 1 wherein said second adhesive is disposed on a second set of tabs, one tab of said second set extending from each of said two sides within said upper panel, wherein each tab is folded inward to seal said envelope.

4. The form described in claim 1 further comprising a third adhesive disposed at an uppermost edge of said upper panel for further sealing said envelope.

5. The form described in claim 1 further comprising a perforated line disposed along said center fold line for separating said pocket from said printed table.

6. The form described in claim 2 further comprising a perforated line disposed between each tab of said first set of tabs and said lower panel.

7. The form described in claim 3 further comprising a perforated line disposed between each tab of said second set of tabs and said upper panel.

8. The form described in claim 1 further comprising a sheet of carbonless duplicating paper having a duplicate of said printed table printed thereon attached to said rectangular sheet so that it overlies said printed table.

9. The form described in claim 1 further comprising at least one divider disposed within said pocket.

10. The form described in claim 1 further comprising a plurality of binder holes pre-punched along one edge of said rectangular sheet.

11. The form described in claim 1 wherein said printed table comprises a listing of business expense categories along one axis and days of the week along the other axis.

12. The form described in claim 1 wherein said rectangular sheet has a width of 8.5 inches and a length on the order of 17 inches.

13. A system for maintaining a record of business expense wherein an integral form provides means for storing receipts, recording expense information, submitting the receipts and information to a designated location, and maintaining files of the expense information, the system comprising:

a rectangular sheet of paper having a front, a back, a top, a bottom, a left edge, a right edge and three fold lines dividing said rectangular sheet into four panels;

a first adhesive disposed on said left edge and said right edge of the lowermost panel whereby a pocket is formed by folding said lowermost panel up against the lower center panel so that said first adhesive adheres to the lower center panel;

a printed table disposed on the uppermost panel and the upper center panel onto which expense information is written;

a second adhesive disposed on said left edge and said right edge of the uppermost panel whereby an envelope is formed by folding said rectangular sheet along the fold lines between said lower center panel and said upper center panel, and between said upper center panel and said upper panel, then sealed with said second adhesive; and a printed address of the designated location disposed on said back of said rectangular sheet so that it is exposed when said envelope is formed.

14. The system described in claim 13 further comprising a third adhesive disposed on a top edge of said upper panel for further sealing said envelope.

15. The system described in claim 13 wherein said first adhesive is disposed on a first set of tabs, one tab of said first set extending from each of said left side and said right side within said lower panel, wherein each tab is folded inward to form said pocket.

16. The system described in claim 13 wherein said second adhesive is disposed on a second set of tabs, one tab of said second set extending from each of said left side and said right side within said upper panel, wherein each tab is folded inward to form said envelope.

17. The system described in claim 13 further comprising a perforated line disposed along the fold line between said upper center panel and said lower center panel for separating said pocket from said printed table.

18. The system described in claim 15 further comprising a perforated line disposed between each tab of said first set of tabs and said lower panel.

19. The system described in claim 16 further comprising a perforated line disposed between each tab of said second set of tabs and said upper panel.

20. The system described in claim 13 further comprising a sheet of carbonless duplicating paper having a duplicate of said printed table printed thereon attached to said rectangular sheet so that it overlies said printed table.

21. The system described in claim 13 further comprising at least one divider disposed within said pocket.

22. The system described in claim 13 further comprising a plurality of binder holes pre-punched along one edge of said rectangular sheet.

23. The system described in claim 13 wherein said printed table comprises a listing of business expense categories along one axis and days of the week along the other axis.

24. The system described in claim 13 wherein said rectangular sheet has a width of 8.5 inches and a length on the order of 17 inches.

* * * * *